US012460869B2

(12) United States Patent
Eguchi et al.

(10) Patent No.: US 12,460,869 B2
(45) Date of Patent: Nov. 4, 2025

(54) HEAT EXCHANGE CORE, HEAT EXCHANGER, AND METHOD FOR MANUFACTURING HEAT EXCHANGE CORE

(71) Applicant: MITSUBISHI HEAVY INDUSTRIES, LTD., Tokyo (JP)

(72) Inventors: Shunsaku Eguchi, Tokyo (JP); Minemasa Omura, Tokyo (JP); Takuo Oda, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 903 days.

(21) Appl. No.: 17/637,521

(22) PCT Filed: Feb. 26, 2020

(86) PCT No.: PCT/JP2020/007696
§ 371 (c)(1),
(2) Date: Feb. 23, 2022

(87) PCT Pub. No.: WO2021/044648
PCT Pub. Date: Mar. 11, 2021

(65) Prior Publication Data

US 2022/0290924 A1 Sep. 15, 2022

(30) Foreign Application Priority Data

Sep. 4, 2019 (JP) ..... 2019-161152

(51) Int. Cl.
*F28D 7/10* (2006.01)
*F28D 1/02* (2006.01)

(52) U.S. Cl.
CPC ..... *F28D 7/10* (2013.01); *F28D 1/02* (2013.01); *F28D 2001/0266* (2013.01)

(58) Field of Classification Search
CPC ..... F28D 7/10; F28D 2001/0266; F28D 9/0018; F28D 7/04; F28D 7/06
See application file for complete search history.

(56) References Cited

U.S. PATENT DOCUMENTS 4,063,589 A * 12/1977 Battcock ..... F28D 7/04 34/578
5,524,706 A 6/1996 Nakamura et al.
(Continued)

FOREIGN PATENT DOCUMENTS

DE 4010151 10/1990
EP 1 972 863 9/2008
(Continued)

OTHER PUBLICATIONS

International Preliminary Report on Patentability issued on Mar. 17, 2022, in International (PCT) Application No. PCT/JP2020/007696.
International Search Report issued on Apr. 28, 2020, in Japanese Patent Application No. PCT/JP2020/007696.

*Primary Examiner* — Jianying C Atkisson
*Assistant Examiner* — Khaled Ahmed Ali Al Samiri
(74) *Attorney, Agent, or Firm* — Wenderoth, Lind & Ponack, L.L.P.

(57) ABSTRACT

Provided is a technique to achieve equalization of stress in a heat exchange core. The heat exchange core which performs heat exchange between a first fluid and a second fluid includes a circular first cross-section in which a first flow path group for the first fluid and a second flow path group for the second fluid are positioned. First flow paths included in the first flow path group and second flow paths included in the second flow path group are annularly arranged in the first cross-section. The first flow path group and the second flow path group are concentrically arranged as a whole in the first cross-section. Each of the first flow paths and the second
(Continued)

flow paths is divided into a plurality of sections in a circumferential direction of the heat exchange core.

11 Claims, 12 Drawing Sheets

(56) References Cited

U.S. PATENT DOCUMENTS

| | | | | |
|---|---|---|---|---|
| 2003/0131978 | A1* | 7/2003 | Nakano | F28D 9/0018 165/164 |
| 2016/0054071 | A1 | 2/2016 | Cordova et al. | |
| 2017/0219295 | A1* | 8/2017 | Kenworthy | F28F 3/044 |
| 2018/0345353 | A1* | 12/2018 | Martin | F28F 3/025 |
| 2019/0120562 | A1 | 4/2019 | Fuller | |

FOREIGN PATENT DOCUMENTS

| | | |
|---|---|---|
| JP | 64-075891 | 3/1899 |
| JP | 56-146986 | 11/1981 |
| JP | 59-195096 | 11/1984 |
| JP | 61-149790 | 7/1986 |
| JP | 5-060475 | 3/1993 |
| JP | 5-154467 | 6/1993 |
| JP | 8-261670 | 10/1996 |
| JP | 3406896 | 3/2003 |
| JP | 2014-529498 | 11/2014 |
| JP | 2015-42934 | 3/2015 |
| JP | 2019-007649 | 1/2019 |
| JP | 2019-039659 | 3/2019 |
| WO | 96/12145 | 4/1996 |
| WO | 2007/105815 | 9/2007 |
| WO | 2013/028815 | 2/2013 |

* cited by examiner

HEAT EXCHANGE CORE, HEAT EXCHANGER, AND METHOD FOR MANUFACTURING HEAT EXCHANGE CORE

TECHNICAL FIELD

The present disclosure relates to a heat exchange core which performs heat exchange between a first fluid and a second fluid, a heat exchanger including the heat exchange core and a casing, and a method of manufacturing the heat exchange core.

BACKGROUND ART

A heat exchanger is used in a wide industrial field, for example, in an air-conditioning apparatus, a freezer, a gas turbine, a chemical plant such as a $CO_2$ recovery apparatus, and a transport machinery.

While various heat exchangers are used, a plate heat exchanger that includes a stacked body of plates and alternately includes a flow path for a first fluid and a flow path for a second fluid in a stacking direction of the plates is known. Each of the flow paths is formed between any two adjacent plates by a gasket made of a rubber material, disposed on a peripheral edge of each of the plates. The first fluid and the second fluid flows in between the plates from a direction orthogonal to the plates. The first fluid sequentially flows through the flow path between the plates from one side toward the other side in the stacking direction of the plates. The first fluid and the second fluid exchange heat through the plates.

In addition, a heat exchanger in which a heat exchange core including a stacked body of plates is housed in a cylindrical casing is also known (Patent Literature 1). In Patent Literature 1, a shape of a cross-section of the heat exchange core is set to be a circular shape following a shape of a cross-section of the casing. An area of each of the plates arranged in a top-down direction so as to divide the cross-section of the heat exchange core is large at a center in a height direction of the heat exchange core, and is small at an upper end and a lower end.

In Patent Literature 1, the first fluid and the second fluid exchange heat while flowing through flow paths alternately formed between the plates in the top-down direction, along the plates in an axial direction of the casing. The second fluid flows in between the plates from a first end in an axial direction of the heat exchange core, and flows out from a second end in the axial direction of the heat exchange core to outside of the heat exchange core. On the other hand, inflow ports and outflow ports for the first fluid are both positioned on side walls of the heat exchange core. The first fluid flows in between the plates from a direction orthogonal to the axial direction of the heat exchange core, through the inflow ports positioned near the second end of the heat exchange core. Further, the first fluid flows out to the outside through the outflows port positioned near the first end of the heat exchange core.

According to Patent Literature 1, sizes of the inflow ports and sizes of the outflow ports for the first fluid arranged on the side walls of the heat exchange core are made different based on the areas of the plates. As a result, a flow rate of the first fluid per unit heat transfer area is made constant, which enables the heat exchange with high efficiency.

CITATION LIST

Patent Literature

Patent Literature 1: JP 3406896 B2

SUMMARY OF INVENTION

Technical Problem

In the above-described plate heat exchanger, the gaskets sealing the spaces between the plates are used. Therefore, in maintenance performed in order to prevent leakage of the fluids, inspection, replacement, and the like of the gaskets are particularly troublesome. In terms of reduction of a maintenance cost, it is desirable to avoid use of the gaskets.

On the other hand, in Patent Literature 1, since the plates different in heat transfer area are arranged asymmetrically about an axial center, stress concentration easily occurs in the heat exchange core.

An object of the present disclosure is to achieve equalization of stress in the heat exchange core.

Solution to Problem

A heat exchange core according to the present disclosure performs heat exchange between a first fluid and a second fluid, and includes a circular first cross-section in which a first flow path group for the first fluid and a second flow path group for the second fluid are positioned. First flow paths included in the first flow path group and second flow paths included in the second flow path group are annularly arranged in the first cross-section. The first flow path group and the second flow path group are concentrically arranged as a whole in the first cross-section. Each of the first flow paths and the second flow paths is divided into a plurality of sections in a circumferential direction of the heat exchange core.

A heat exchanger according to the present disclosure includes the above-described heat exchange core, and a casing having a circular cross-section and housing the heat exchange core. Two or more traverse paths are distributed in the circumferential direction of the heat exchange core. A communication space communicating the two or more traverse paths with outside of the heat exchange core is provided around the heat exchange core inside the casing.

In a method of manufacturing a heat exchange core which performs heat exchange between a first fluid and a second fluid according to the present disclosure, the heat exchange core includes a circular first cross-section in which a first flow path group for the first fluid and a second flow path group for the second fluid are positioned, first flow paths included in the first flow path group and second flow paths included in the second flow path group are annularly arranged in the first cross-section, and the first flow path group and the second flow path group are concentrically arranged as a whole in the first cross-section. The method includes forming the first flow path group and the second flow path group by additive manufacturing using a metal material.

Advantageous Effects of Invention

According to the present disclosure, based on the configuration of the heat exchange core including the first flow path group and the second flow path group concentrically arranged, the stress can be uniformly distributed to whole of the heat exchange core. In addition, the flow state of the first fluid and the flow state of the second fluid is made uniform over the whole of the heat exchange core while heat transfer area of the first fluid and the second fluid is largely secured. Therefore, heat exchange can be efficiently performed.

Accordingly, it is possible to improve reliability by preventing damage to the heat exchange core caused by stress concentration, and to attain the same heat exchange performance by the smaller-sized heat exchange core.

SCHEMATIC CONFIGURATION OF HEAT EXCHANGER

Figure 1:
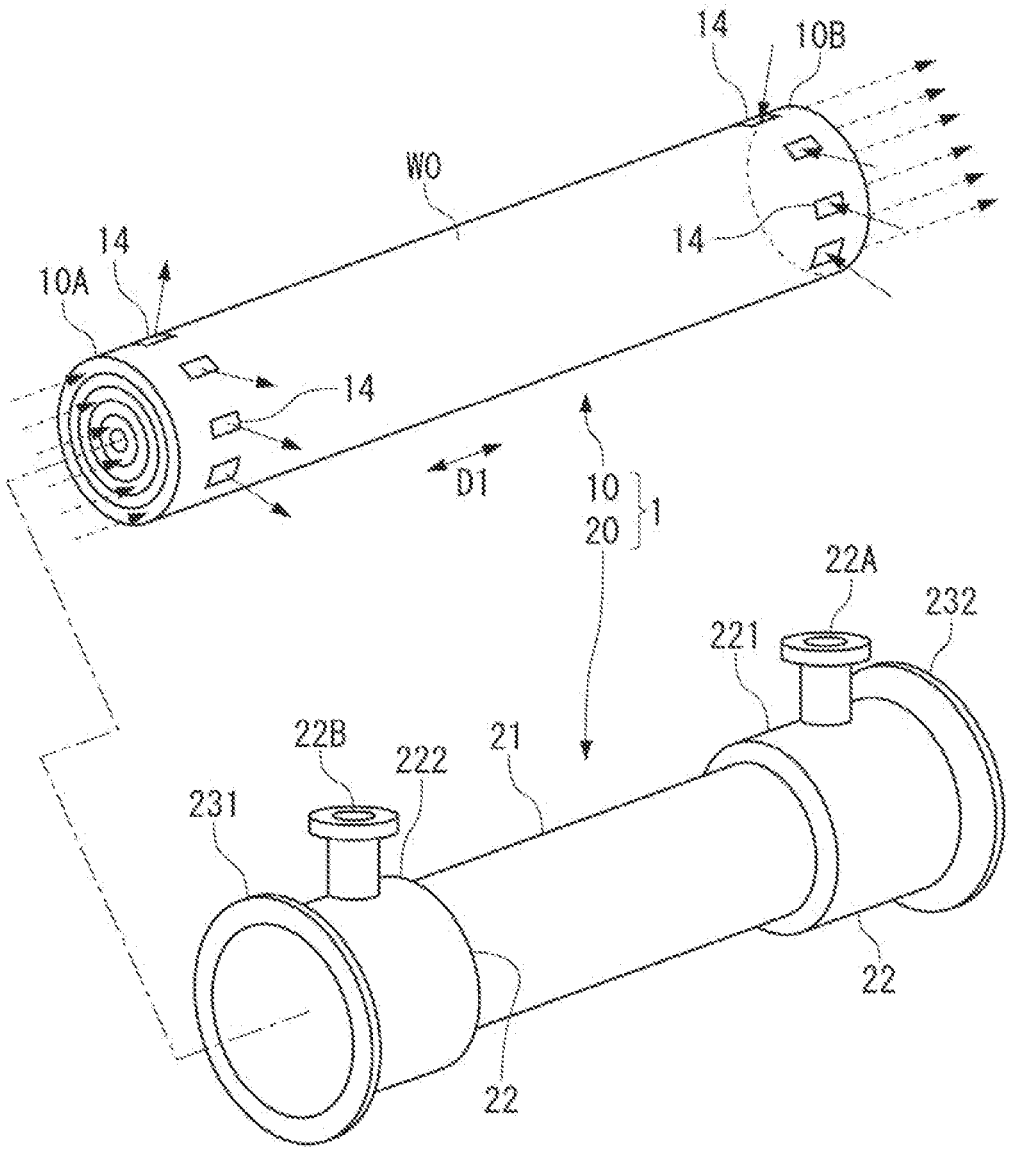
FIG. 1 is an exploded perspective view illustrating a heat exchange core and a casing included in a heat exchanger according to an embodiment of the present disclosure.
Figure 2:
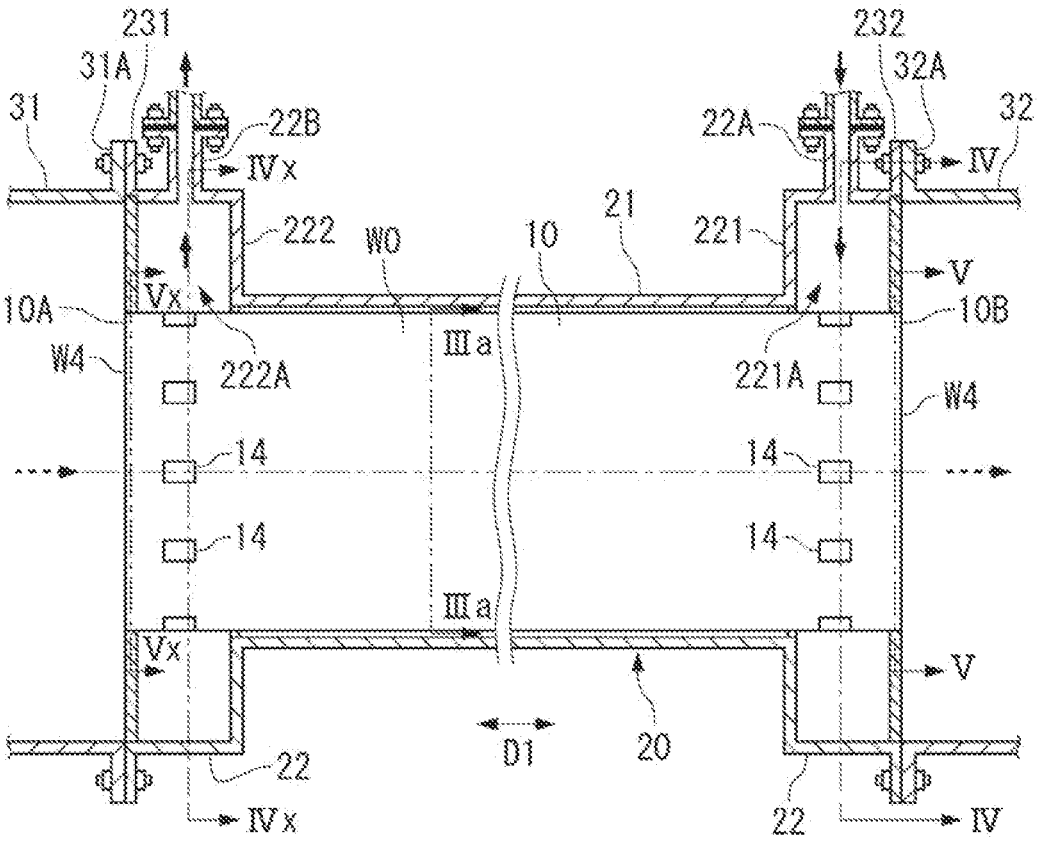
FIG. 2 is a partial cross-sectional view illustrating the casing of the heat exchanger illustrated in FIG. 1 and the heat exchange core housed in the casing.

A heat exchanger 1 illustrated in FIG. 1 and FIG. 2 includes a heat exchange core 10 and a casing 20 housing the heat exchange core 10.

The heat exchanger 1 can be incorporated in, for example, a gas turbine, a chemical plant such as a $CO_2$ recovery apparatus, and an unillustrated apparatus such as an air-conditioning apparatus and a freezer, and performs heat exchange between a first fluid and a second fluid. A temperature of the first fluid is relatively high, whereas a temperature of the second fluid is relatively low. To the contrary, the temperature of the first fluid may be relatively low, and the temperature of the second fluid may be relatively high.

(Configuration of Heat Exchange Core)

Figure 3A:
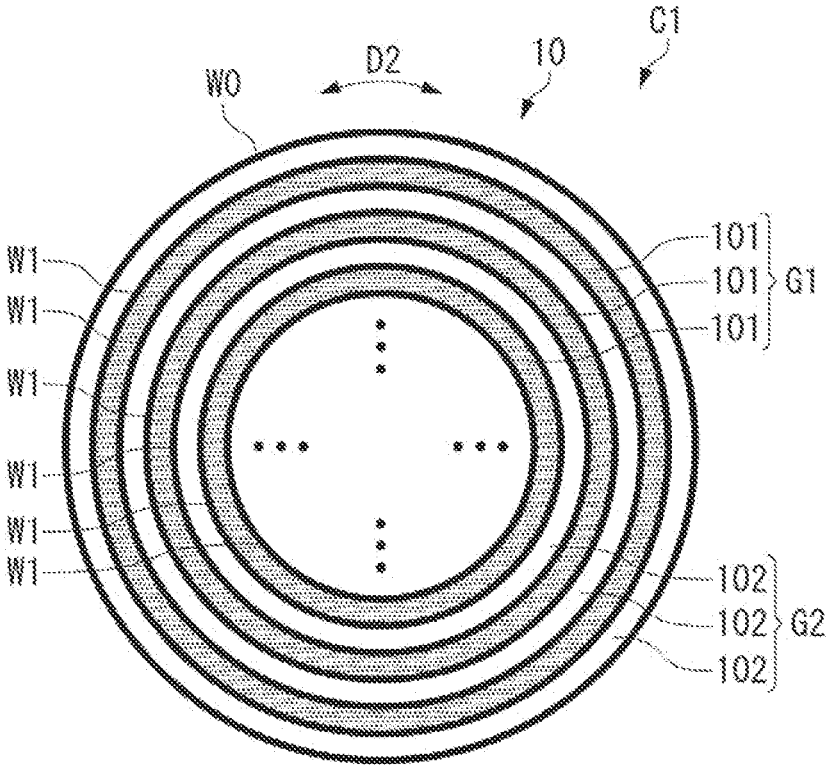
FIG. 3A is a cross-sectional view taken along line IIIa-IIIa in FIG. 2 (first cross-section of heat exchange core) and illustrates a first flow path group and a second flow path group.

As illustrated in FIG. 1 and FIG. 3A that is a cross-sectional view taken along line IIIa-IIIa in FIG. 2, the heat exchange core 10 includes a first flow path group G1 and a second flow path group G2 that are concentrically arranged as a whole.

Figure 4:
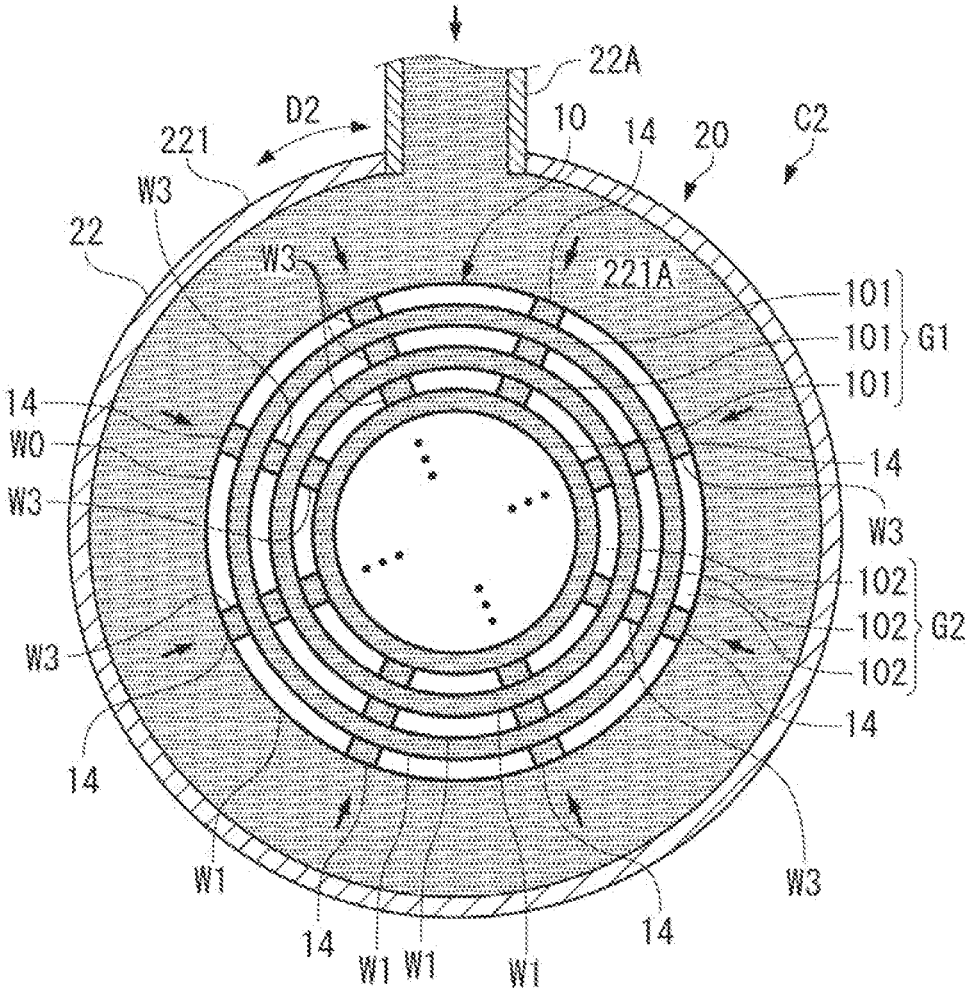
FIG. 4 is a cross-sectional view taken along line IV-IV in FIG. 2 (second cross-section of heat exchange core).
Figure 5:
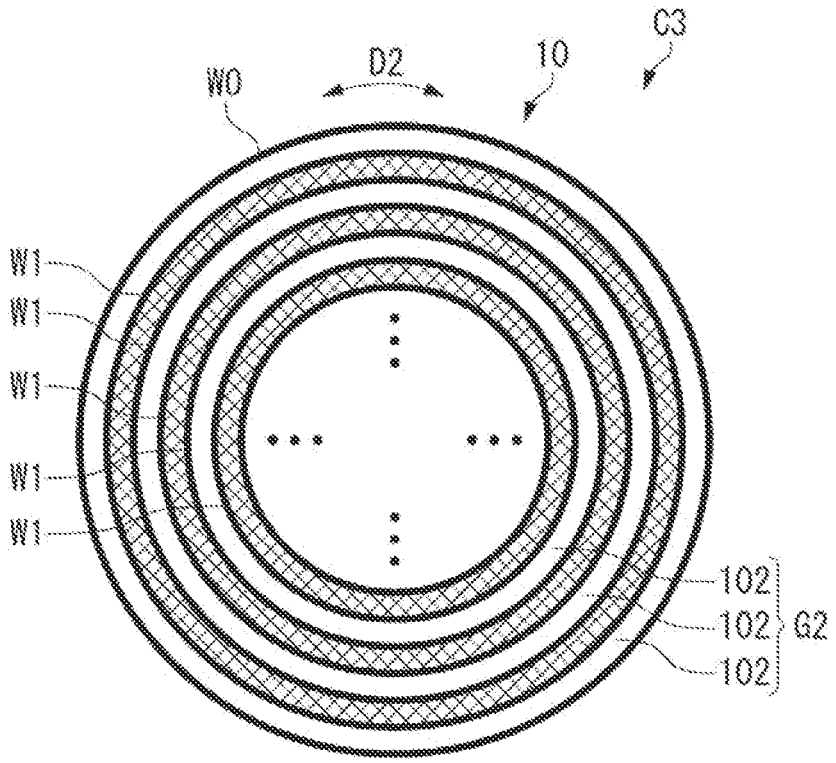
FIG. 5 is a cross-sectional view taken along line V-V in FIG. 2 and FIG. 6 (third cross-section of heat exchange core).

The heat exchanger 1 includes a first cross-section C1 illustrated in FIG. 3A, a second cross-section C2 illustrated in FIG. 4, and a third cross-section C3 illustrated in FIG. 5. Each of these cross-sections C1 to C3 has a circular shape. An entire outer shape of the heat exchange core 10 is a cylindrical shape. The heat exchange core 10 includes partition walls W1 that are concentrically arranged to partition the first flow path group G1 and the second flow path group G2, and a side wall W0 disposed on an outermost periphery of the heat exchange core 10.

The heat exchange core 10 has a shape symmetrical about a center of each of the cross-sections C1 to C3 not only in the outer shape but also in the whole shape. This can contribute to equalization of stress and to equalization of heat exchange efficiency.

The first flow path group G1 is for the first fluid, and the second flow path group G2 is for the second fluid. In each of the drawings, the first flow path group G1 is illustrated with a hatching pattern.

The second flow path group G2 extends from one end 10A (FIG. 1) to the other end 10B (FIG. 1) in an axial direction D1 of the heat exchange core 10. The axial direction D1 is orthogonal to the cross-sections C1 to C3.

In each of the drawings, a flow of the first fluid is illustrated by a solid arrow, and a flow of the second fluid is illustrated by a dashed arrow.

First flow paths 101 included in the first flow path group G1 are annularly arranged in the first cross-section C1 illustrated in FIG. 3A. Second flow paths 102 included in the second flow path group G2 are similarly arranged. The first fluid flowing through the first flow path group G1 and the second fluid flowing through the second flow path group G2 exchange heat by indirectly coming into contact with each other through the partition walls W1 illustrated by thick lines in FIG. 3A.

As illustrated in FIG. 3A, the plurality of first flow paths 101 and the plurality of second flow paths 102 are preferably alternately stacked over, for example, several ten layers in a radial direction of the heat exchange core 10.

The first flow paths 101 and the second flow paths 102 are preferably disposed over the whole in the radial direction of the heat exchange core 10, namely, up to a vicinity of an axial center of the heat exchange core 10. In FIG. 3A, FIG. 3B, FIG. 4, and FIG. 5, some of the first flow paths 101 and some of the second flow paths 102 are only illustrated. Illustrations of the first flow paths 101 and the second flow paths 102 in an area illustrated by a symbol " . . . " are omitted.

As in the present embodiment, arranging the first flow paths 101 and the second flow paths 102 over the whole in the radial direction of the heat exchange core 10 enables the whole of the heat exchange core 10 to contribute to heat exchange.

The heat exchange core 10 may have a constant cross-sectional shape corresponding to the first cross-section C1 (FIG. 3A) in a range between line IV-IV and line IVx-IVx illustrated in FIG. 2. In the present embodiment, the first fluid and the second fluid flow in opposite directions along the axial direction D1 within that range, namely, within the range from the vicinity of the one end 10A to the vicinity of the other end 10B of the heat exchange core 10. In other words, the first fluid and the second fluid form countercurrent flows (full countercurrent flows) over substantially the whole in the axial direction D1 of the heat exchange core 10 except for both ends.

The first fluid and the second fluid may flow in the same direction along the axial direction D1. In this case, the first fluid and the second fluid form parallel current flows.

The heat exchange core 10 has an appropriate dimension in each of the axial direction D1 and the radial direction, a flow path cross-sectional area, the stacked number of flow paths 101 and 102, and the like, in consideration of necessary heat exchange capacity, stress, and the like.

Figure 3B:
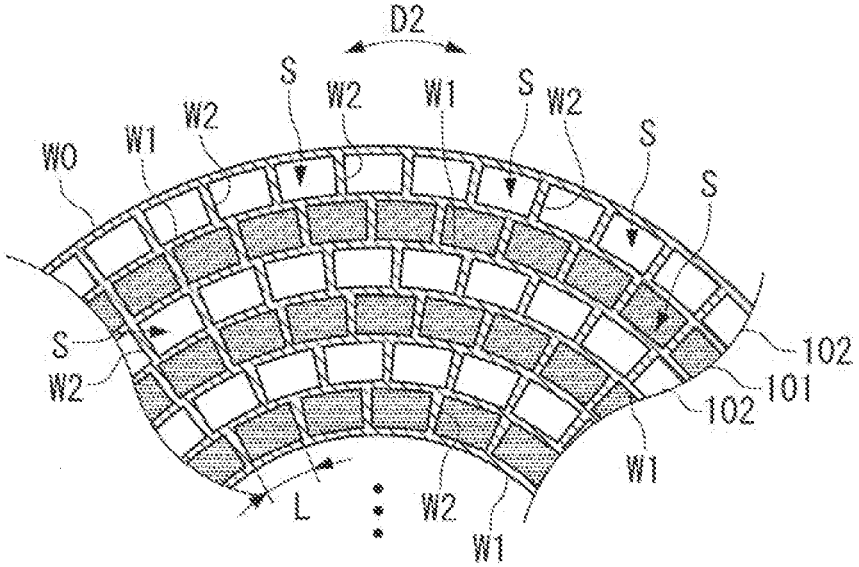
FIG. 3B is a partial enlarged view of FIG. 3A, and illustrations of dividing walls (W2) are omitted in drawings other than FIG. 3B.

As illustrated in FIG. 3B, each of the first flow paths 101 and the second flow paths 102 is preferably divided into a plurality of sections S by dividing walls W2 in a circumferential direction D2 of the heat exchange core 10. Installation of the dividing walls W2 makes it possible to improve rigidity and strength particularly in the radial direction against pressure of the fluids.

Further, when each of the first flow paths 101 and the second flow paths 102 is subdivided into the sections S by the dividing walls W2, the surface areas of the flow paths coming into contact with the fluids are increased, so that heat transfer efficiency can be improved.

The reduction in diameter of each of the flow paths 101 and 102 by the dividing walls W2 makes it possible to reduce stress generated in the circumferential direction of the flow paths 101 and 102, and to enable reduction in thickness of the partition walls W1 between the respective flow paths 101 and 102. Accordingly, it is possible to reduce thermal resistance by the partition walls W1, and to achieve improvement in heat transfer efficiency and downsizing and light weight of the heat exchanger 1.

The sections S each preferably have an equal flow path diameter and are preferably arranged over the entire circumference of the heat exchange core 10. Further, all of the sections S arranged from the outermost periphery to the axial center of the heat exchange core 10 each have an equal flow path diameter. As a result, a flow state such as friction loss is made uniform among all of the sections S, and heat transfer coefficient can be accordingly made uniform among all of the sections S. In addition, the stress acting on the heat exchange core 10 is uniformly distributed to the whole in an in-plane direction of the cross-section of the heat exchange core 10, which makes it possible to equalize the stress.

Note that heights (dimension in radial direction) of the sections S are not necessarily equal in the layers of the heat exchange core 10.

The "flow path diameter" in the present specification corresponds to an equivalent diameter D derived from the following expression (1), $$D=4A/L \quad (1)$$

where A is a cross-sectional area of each of the sections S, and L is a length (perimeter) of each of the sections S in the circumferential direction D2.

The heat transfer coefficient corresponds to a reciprocal of the flow path diameter. Therefore, it is desirable to impart the appropriate flow path diameter to each of the sections S based on this.

A necessary thickness is imparted to each of the dividing walls W2 depending on pressure resistance of the flow paths. If the flow path diameter of each of the sections S is increased toward the outside in the radial direction of the heat exchange core 10 and the flow path cross-sectional area is increased toward the outside in the radial direction unlike the arrangement of the sections S illustrated in FIG. 3B, it is necessary to increase the thickness of each of the dividing walls W2 toward the outside in the radial direction in terms of relationship with pressure resistance. The heat transfer coefficient is reduced as the flow path diameter is increased. This causes upsizing of the heat exchanger 1.

Accordingly, when the heat exchange core 10 is designed such that the flow path cross-sectional areas of the sections S are made equal in the layers of the heat exchange core 10, it is possible to secure predetermined heat transfer performance and pressure resistance while avoiding upsizing of the heat exchanger 1.

The heat exchange core 10 can be integrally formed together with the dividing walls W2 by additive manufacturing or the like, by using a metal material having characteristics suitable for the fluids, for example, stainless steel or an aluminum alloy. The additive manufacturing can provide a product in which two-dimensional shapes are stacked, by repeating, for example, supply of metal powder to a formation area in an apparatus, irradiation of a laser beam or an electron beam based on two-dimensional data representing three-dimensional cross-section, melting of the metal powder, and solidification of the metal powder.

The thickness of each of the walls W1 and the like of the heat exchange core 10 obtained by the additive manufacturing using the metal material is, for example, 0.3 mm to 3 mm.

The heat exchange core 10 according to the present embodiment is manufactured through a step of forming the first flow path group G1 and the second flow path group G2 by the additive manufacturing using the metal material. As necessary, polishing and the like can be performed on the product obtained through the forming step by the additive manufacturing.

The heat exchange core 10 can be integrally formed by cutting or the like without being limited to the additive manufacturing.

The heat exchange core 10 can be configured by combining the plurality of partition walls W1 formed by bending metal plates; however, the heat exchange core 10 is preferably formed integrally. In the case where the heat exchange core 10 is integrally formed, the heat exchange core 10 does not need a gasket preventing the fluids from leaking from a gap between members.

In a case of using the gasket, it is necessary for the gasket to have an appropriate elastic deformation amount in order to reliably seal the gap between the members. In this case, to prevent leakage of the fluids, it is necessary to perform maintenance, for example, disassembly of the members of the heat exchange core and refastening of the gasket between the members. To prevent damage of the gasket due to, for example, change in deformation amount caused by tolerance of a gasket, assembling tolerance, change in pressure of the fluids, change of the gasket with time, or thermal stress, maintenance necessity for the gasket is particularly high.

In contrast, since the integrally-formed heat exchange core 10 according to the present embodiment does not include the gasket, it is possible to largely reduce a time and effort for the maintenance.

(Casing and Header)

As illustrated in FIG. 1 and FIG. 2, the casing 20 is formed in a substantially cylindrical shape as a whole. The casing 20 is made of, for example, stainless steel or an aluminum alloy having characteristics suitable for the fluids.

The casing 20 includes a casing main body 21 that has an inner diameter corresponding to an outer diameter of the heat exchange core 10 and has a circular cross-section, and large-diameter portions 22 each having a diameter greater than a diameter of the casing main body 21. The large-diameter portions 22 are provided on respective ends of the casing main body 21 in the axial direction D1. These large-diameter portions 22 function as a first inlet header 221 and a first outlet header 222.

These headers 221 and 222 respectively include annular internal spaces 221A and 222A (FIG. 2) as communication spaces around the side wall W0 of the heat exchange core 10.

The first inlet header 221 includes an inlet port 22A through which the first fluid flows in from the outside. The first outlet header 222 includes an outlet port 22B through which the first fluid flows out to the outside.

The inlet port 22A may be provided not only at one position but also at each of a plurality of positions in the circumferential direction D2. For example, two inlet ports 22A may be disposed point-symmetrically about the center of the second cross-section C2. This is true of the outlet port 22B.

In each of the internal spaces 221A and 222A of the headers 221 and 222, a flow path cross-sectional area in a direction (radial direction) intersecting the circumferential direction is sufficiently secured. Therefore, resistance of the first fluid in each of the internal spaces 221A and 222A is less than resistance of the first fluid in each of traverse paths 14 described below. Thus, the first fluid equally flows into the first flow path group G1 from the first inlet header 221 through the traverse paths 14, and the first fluid equally flowing through the first flow path group G1 flows out to the first outlet header 222 through the traverse paths 14.

At the one end 10A of the casing 20 in the axial direction D1, a second inlet header 31 is provided. At the other end 10B of the casing 20 in the axial direction D1, a second outlet header 32 is provided.

A gap between a flange 31A of the second inlet header 31 and a flange 231 of the casing 20 is sealed by an unillustrated annular seal member. A gap between a flange 32A of the second outlet header 32 and a flange 232 of the casing 20 is also sealed in a similar manner.

The first flow path group G1 is connected to an inside of the first inlet header 221 and an inside of the first outlet header 222.

The second flow path group G2 is connected to an inside of the second inlet header 31 and an inside of the second outlet header 32. A start end of each of the second flow paths 102 opens inside the second inlet header 31. A terminal end of each of the second flow paths 102 opens inside the second outlet header 32.

Among the flow paths 101 and 102 concentrically arranged, the flow path disposed on the outermost periphery is preferably a flow path into which the second fluid flows from the second inlet header 31 in the axial direction D1 and from which the second fluid flows out to the second outlet header 32 in the axial direction D1, like each of the second flow paths 102 according to the present embodiment. As a result, even if short pass in which the first fluid flowing in from the first inlet header 221 in the radial direction of the heat exchange core 10 flows into a gap between the heat exchange core 10 and the casing 20 occurs, heat can be exchanged between the first fluid flowing through the gap and the second fluid flowing through the second flow path 102 on the outermost periphery. Therefore, deterioration of heat exchange efficiency caused by the short pass can be prevented.

Inflow directions and outflow directions of the first fluid and the second fluid into/from the heat exchange core 10 can be appropriately determined by considering layout of the inflow paths and the outflow paths, interference of the headers with the first fluid and the second fluid, and the like.

For example, in contrast to the present embodiment, the heat exchange core 10 can be configured such that, at the one end 10A of the heat exchange core 10, the first fluid flows into the first flow path group G1 along the axial direction D1, and the second fluid flows into the second flow path group G2 along the radial direction of the heat exchange core 10. In this case, the traverse paths 14 described below can be configured so as to communicate with only the second flow path group G2 out of the first flow path group G1 and the second flow path group G2.

(Definition of Circular Shape, Annular Shape, and Concentric Shape)

The cross-section of the casing 20 is not strictly limited to the circular shape, and may be formed in a substantially circular shape. In the present specification, the substantially circular shape is included in the "circular shape". In addition, the "circular shape" is allowed to have tolerance to a true circle.

The "circular shape" includes, for example, a polygonal shape including a number of vertices (for example, decagon shape to icosagon), and a shape having an n-fold rotational symmetry where n is, for example, 10 to 20. In addition, a shape in which arcs are continuous over substantially the whole in the circumferential direction D2 and irregularities are present on a part of the circumference is also included in the "circular shape".

As in the above description, each of the cross-sections C1 to C3 of the heat exchange core 10 is not strictly limited to the circular shape, and may be a substantially circular shape. As described above, the substantially circular shape is included in the "circular shape". In the first cross-section C1, it is sufficient for each of the first flow paths 101 and the second flow paths 102 to be formed in the substantially annular shape. Likewise, it is sufficient for the first flow path group G1 and the second flow path group G2 to be substantially concentrically arranged. Similarly to the above-described definition of the circular shape, the substantially annular shape is included in the "annular shape", and the substantially concentric shape is included in the "concentric shape" in the present specification.

Figure 7:
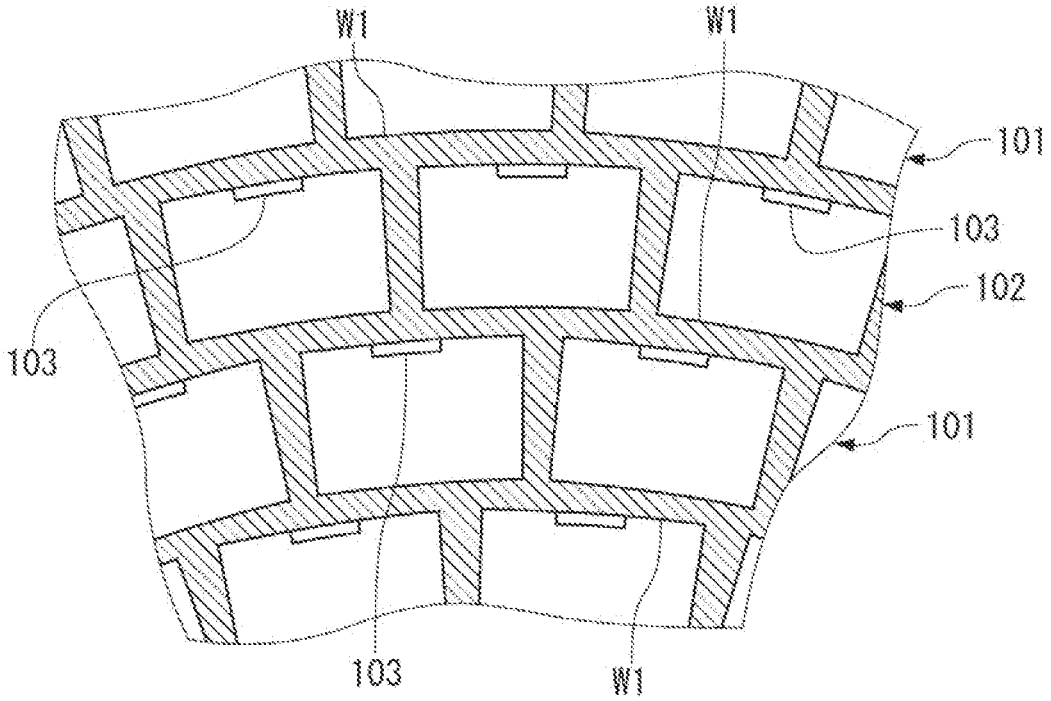
FIG. 7 is a cross-sectional view illustrating a part of a heat exchange core according to a modification of the present disclosure.

To increase the heat transfer area, each of the partition walls W1 may include a plurality of protrusions 103 rising from each of the partition walls W1 toward at least one of the first flow path 101 and the second flow path 102, as illustrated in FIG. 7. The protrusions 103 are preferably provided on each of the partition walls W1 other than both ends of each of the first flow paths 101 in the axial direction D1 in order to cause the first fluid to smoothly flow from the traverse paths 14 described below into the first flow paths 101 with reducing pressure loss and to cause the first fluid to smoothly flow out from the first flow paths 101 to the traverse paths 14.

The heat exchange core 10 including the protrusions 103 can be integrally formed by additive manufacturing.

The "concentric shape" in which a plurality of circular shapes different in diameter are concentrically arranged is allowed to have tolerance to coincidence of centers of the respective circular shapes (concentricity). In other words, the "substantially concentric shape" includes a form in which the circular shapes are substantially concentrically arranged. The circular elements constituting the concentric circles follow the meaning of the above-described substantially circular shape. The plurality of polygonal shapes can be "substantially concentrically" arranged while the centers of the respective polygonal shapes are made coincident with one another or the centers of the polygonal shape and the rotationally symmetrical shape are made coincident with one another.

A case where the cross-sections of the casing 20 and the heat exchange core 10 are the circular shapes, the cross-sections of the first flow paths 101 and the second flow paths 102 are the annular shapes, and the first flow path group G1 and the second flow path group G2 are concentrically arranged is most preferable in terms of equalization of the stress, the heat transfer area, and the flow state.

However, in a case where the cross-sections of the casing 20 and the heat exchange core 10 are the substantially circular shapes, the first flow paths 101 and the second flow paths 102 have the substantially annular shapes in the first cross-section C1, or the first flow path group G1 and the second flow path group G2 are substantially concentrically arranged as a whole, it is also possible to achieve effects equivalent to effects described below by the present embodiment.

(Description of Second Cross-Section and Traverse Path)

As illustrated in FIG. 4 corresponding to the cross-section taken along line IV-IV in FIG. 2, the heat exchange core 10 includes the traverse paths 14 that traverse the first flow path group G1 and the second flow path group G2 and communicate with only the first flow path group G1. In the second cross-section C2 illustrated in FIG. 4, the traverse paths 14 extend in the radial direction of the heat exchange core 10 and communicate with the internal space 221A of the first inlet header 221. As illustrated in FIG. 1 and FIG. 2, the traverse paths 14 penetrate through the side wall W0 and the partition walls W1 in the thickness direction.

Although not illustrated, a cross-sectional view taken along line IVx-IVx in FIG. 2 is similar to the cross-sectional view in FIG. 4. The cross-section taken along line IVx-IVx in FIG. 2 corresponds to the second cross-section C2. The cross-section taken along line IVx-IVx is referred to as a second cross-section C2*x*. The traverse paths 14 positioned in the second cross-section C2*x* communicate with the internal space 222A of the first outlet header 222.

In each of the second cross-section C2 and the second cross-section C2*x*, the plurality of (eight in present embodiment) traverse paths 14 are distributed in the circumferential direction D2. Since the plurality of traverse paths 14 are distributed in the circumferential direction D2, rigidity and strength of the heat exchange core 10 can be made uniform in the circumferential direction D2, and the flow state of the first fluid in the circumferential direction D2 can be made uniform.

The flow rate of the first fluid flowing in each of the traverse paths 14 is easily equalized as the number of traverse paths 14 is large. As a result, heat is sufficiently exchanged between the first fluid and the second fluid equally flowing over the whole in the circumferential direction D2. In consideration thereof, in each of the second cross-sections C2 and C2*x*, four or more traverse paths 14 are preferably distributed. However, in each of the second cross-sections C2 and C2*x*, the number of traverse paths 14 may be three or less (including one).

To contribute to equalization of the flow rate of the first fluid flowing through each of the traverse paths 14, the plurality of traverse paths 14 are preferably distributed with equal intervals in the circumferential direction D2. In other words, the heat exchange core 10 is preferably formed symmetrically about the center of each of the second cross-sections C2 and C2*x*.

Furthermore, the flow path cross-sectional areas of the respective traverse paths 14 are preferably equal to one another. This makes it possible to uniformly secure a length of a section where the first fluid and the second fluid flow in countercurrent flow manner along the axial direction D1, in the circumferential direction D2 of the first flow paths 101 and the second flow paths 102. The tolerance of the flow path cross-sectional area of each of the traverse paths 14 is allowed.

The cross-sectional shapes and the opening shapes in the side wall W0 of the traverse paths 14 are rectangular shapes in the example illustrated in FIG. 1 and FIG. 2, but may be appropriate shapes such as circular shapes. The openings of the traverse paths 14 are distributed in the side wall W0 in the circumferential direction D2.

In addition, to contribute to equalization of the flow rate of the first fluid flowing through each of the traverse paths 14 as in the above description, the inlet port 22A and the traverse paths 14 are preferably shifted in phase from each other, namely, the inlet port 22A and the traverse paths 14 are preferably disposed at positions different from each other in the circumferential direction D2, as illustrated in FIG. 4. When the inlet port 22A and the traverse paths 14 are shifted in phase, it is possible to more reliably prevent occurrence of disproportion in the flow rate of the first fluid flowing through each of the traverse paths 14, as compared with a case where the inlet port 22A and the traverse paths 14 are not shifted in phase (inlet port 22A and any of traverse paths 14 are positioned at same position in circumferential direction D2).

Each of the traverse paths 14 includes a set of tubular traverse walls W3 positioned in the area of the second flow paths 102. Each of the traverse paths 14 is partitioned from the second flow path group G2 by the traverse walls W3. Each of the traverse walls W3 is provided integrally with the partition walls W1 between any two partition walls W1 adjacent in the radial direction of the heat exchange core 10. Axes of the respective traverse walls W3 are positioned on the same straight line. Each of the first flow paths 101 communicates with the inside of the traverse walls W3.

All of the first flow paths 101 from the first flow path 101 positioned on an outer periphery side of the heat exchange core 10 to the unillustrated first flow path positioned near the axial center of the heat exchange core 10 communicate with the internal space 221A of the first inlet header 221 and the internal space 222A of the first outlet header 222 through the plurality of traverse paths 14 radially extending from the vicinity of the axial center of the heat exchange core 10, and further communicate with the outside of the heat exchanger 1.

(Description of Third Cross-Section)

Figure 6:
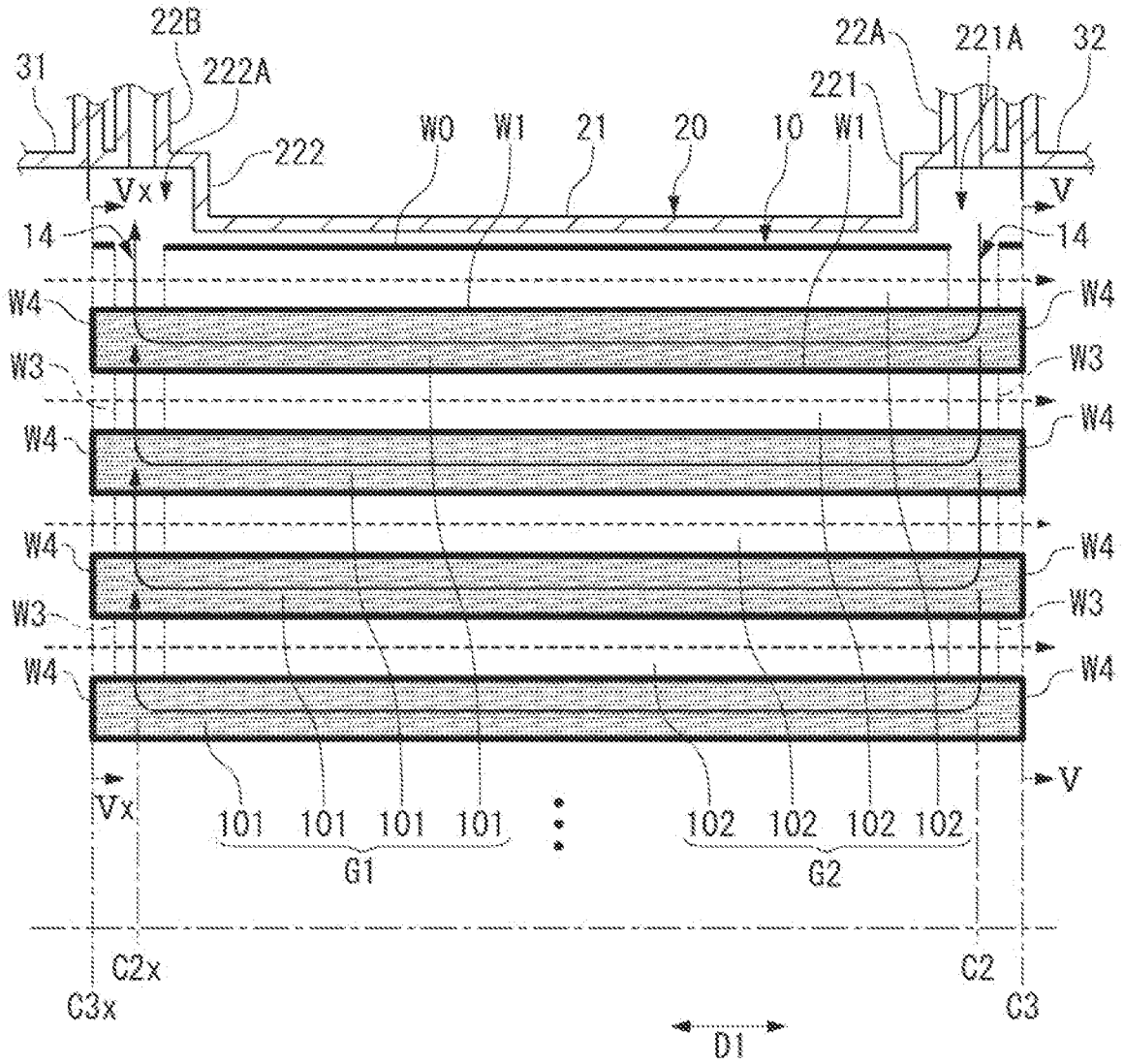
FIG. 6 is a schematic diagram illustrating a flow of each of a first fluid and a second fluid.

FIG. 5 corresponding to the cross-section taken along line V-V in FIG. 2 and FIG. 6 illustrates the third cross-section C3 positioned on the outside of the second cross-section C2 in the axial direction D1.

As illustrated in FIG. 6, the first flow path group G1 communicating with the above-described traverse paths 14 includes closure walls W4 positioned on the outside of the second cross-section C2 in the axial direction D1. The first fluid flowing through the first flow path group G1 does not flow, in the axial direction D1, over the closure walls W4 that intersect the axial direction D1. Each of the closure walls W4 closes a gap between any two adjacent partition walls W1.

The first flow path group G1 is closed in the third cross-section C3 (FIG. 5) by the closure walls W4. Accordingly, only the second flow path group G2 is present in the third cross-section C3. In an area illustrated with a lattice pattern in FIG. 5, the first flow path group G1 is not present.

The second flow path group G2 is opened to the second inlet header 31 and the second outlet header 32 at the respective ends of the heat exchange core 10.

Although not illustrated, a cross-sectional view taken along line Vx-Vx in FIG. 2 is similar to the cross-sectional view in FIG. 5. The cross-section taken along line Vx-Vx in FIG. 2 corresponds to a third cross-section C3*x* positioned on the outside of the second cross-section C2*x* in the axial direction D1. The cross-section taken along line Vx-Vx is referred to as the third cross-section C3*x*.

As illustrated in FIG. 6, the first flow path group G1 is closed in the third cross-section C3*x* by the closure walls W4. Accordingly, only the second flow path group G2 is present in the third cross-section C3*x*.

(Flow of First Fluid and Flow of Second Fluid)

A flow of the first fluid and a flow of the second fluid in the heat exchange core 10 are described with reference to FIG. 2, FIG. 4, and FIG. 6. FIG. 6 illustrates a part of a vertical cross-section of the heat exchange core 10.

As illustrated by dashed arrows in FIG. 6, the second fluid flowing into the second inlet header 31 through an unillustrated inlet port flows into the start ends of the second flow paths 102 of the second flow path group G2. At this time, since the second flow path group G2 is formed symmetrically about the center of the third cross-section C3, the second fluid uniformly flows into the second flow paths 102 over the whole in the circumferential direction D2, and flows through the second flow paths 102 in the axial direction D1. The second fluid flows out from the terminal ends of the second flow paths 102 to the inside of the second outlet header 32, and further flows out to the outside of the heat exchanger 1 through an unillustrated outlet port.

As illustrated by solid arrows in FIG. 6, the first fluid flowing into the internal space 221A of the first inlet header 221 from the inlet port 22A uniformly flows into the first flow group G1 in the circumferential direction D2 through the traverse paths 14 opening in the side wall W0.

At this time, the first fluid is distributed from the inside of the first inlet header 221 to the plurality of traverse paths 14 without being disproportionately distributed to some of the traverse paths 14 close to the inlet port 22A. In each of the traverse paths 14, the first fluid passes through the inside of the traverse walls W3 illustrated by alternate long and two short dashes lines in FIG. 6, and is distributed to the first flow paths 101 toward the inside in the radial direction of the heat exchange core 10.

Thereafter, the flow rate of the first fluid flowing through each of the first flow paths 101 in the axial direction D1 is equally maintained over the whole in the circumferential direction D2, based on the symmetry of the heat exchange core 10 in the second cross-section C2 where the traverse paths 14 are positioned. Accordingly, the heat can be sufficiently exchanged between the second fluid flowing through the second flow paths 102 and the first fluid over the whole of a range where the first cross-section C1 is continued, under the condition of the countercurrent flows that easily secure a large temperature difference between the first fluid and the second fluid while the first fluid and the second fluid flow through the flow paths 101 and 102.

After reaching the terminal ends of the first flow paths 101, the first fluid flowing through the first flow paths 101 in the axial direction D1 is changed in flow direction from the axial direction D1 to the radial direction, passes through the insides of the traverse paths 14 radially arranged from the axial center of the heat exchange core 10, and flows through the traverse paths 14 toward the outside in the radial direction of the heat exchange core 10 while being merged.

Thereafter, the first fluid flowing out from the traverse paths 14 to the inside of the first outlet header 222 flows out from the outlet port 22B to the outside of the heat exchanger 1.

(Main Effects by Present Embodiment)

According to the heat exchanger 1 of the present embodiment described above, based on the configuration of the heat exchange core 10 in which the casing 20 has a shape symmetrical about the axial center and the first flow path group G1 and the second flow path group G2 are symmetrically and concentrically stacked, heat exchange can be efficiently performed over the whole of the heat exchange core 10 through which the first fluid and the second fluid equally flow, while the stress caused by pressure of the fluids and the like is uniformly distributed to the whole of the heat exchange core 10 and the heat transfer area of the first fluid and the second fluid is largely secured.

From the above, it is possible to improve reliability by preventing the heat exchange core 10 from being damaged, and to attain the same heat exchange performance by the smaller-sized heat exchange core 10.

(Modification)

A heat exchanger according to a modification of the present disclosure is described with reference to FIG. 8, FIG. 9A, and FIG. 9B.

Figure 8:
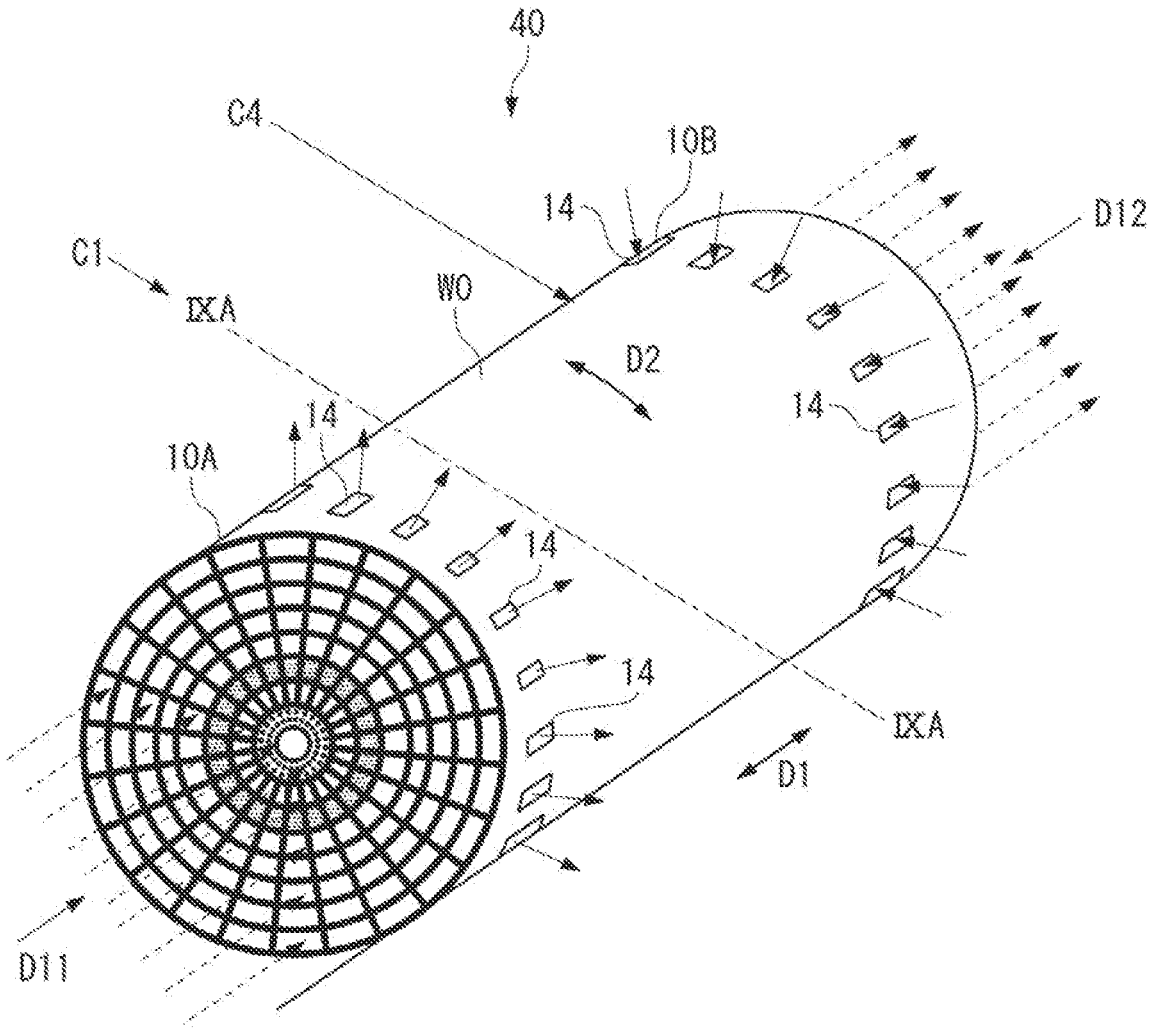
FIG. 8 is a perspective view illustrating a heat exchange core according to another modification of the present disclosure.

The heat exchanger according to the modification includes a heat exchange core 40 illustrated in FIG. 8 and an unillustrated casing. The unillustrated casing housing the heat exchange core 40 is preferably configured in a manner similar to the casing 20 (FIG. 1, FIG. 2, FIG. 4, and FIG. 6) according to the above-described embodiment.

Figure 9A:
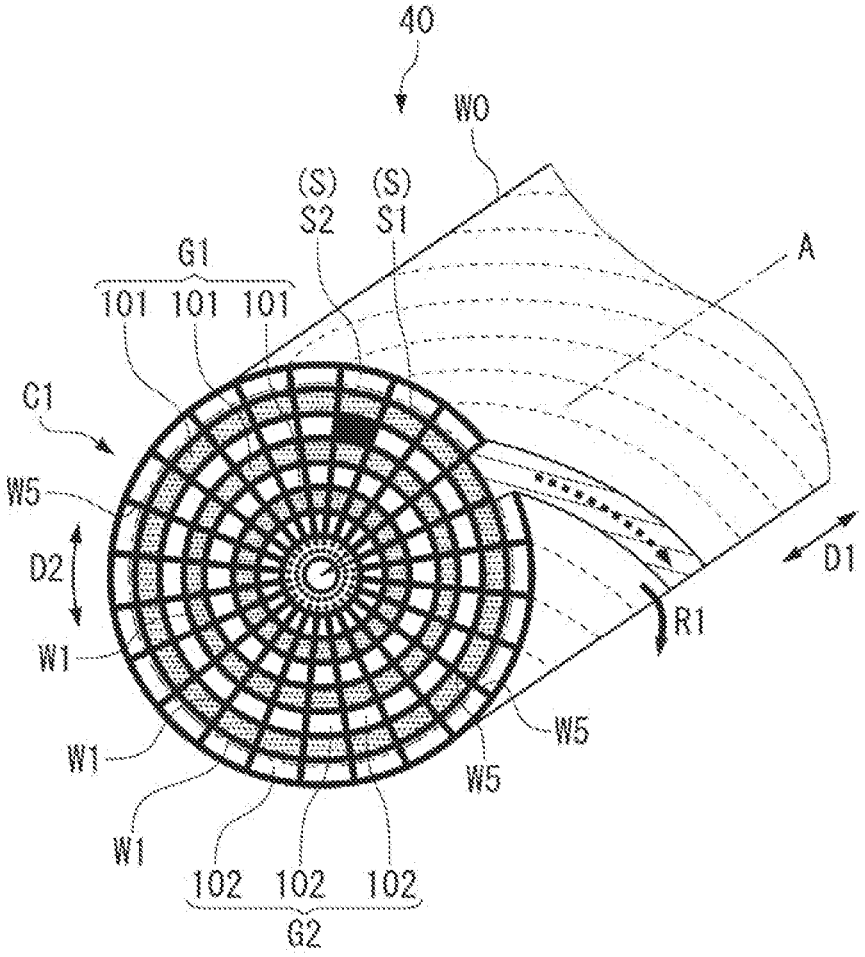
FIG. 9A is a diagram illustrating a cross-section taken along line IXA-IXA of the heat exchange core illustrated in FIG. 8, and shapes of sections of second flow paths.

FIG. 9A illustrates a cross-section (first cross-section C1) of the heat exchange core 40 taken along line IXA-IXA in FIG. 8. As illustrated in FIG. 9A, the heat exchange core 40 includes the first flow path group G1 and the second flow path group G2 that are concentrically arranged as a whole, as with the heat exchange core 10 according to the above-described embodiment. The heat exchange core 40 can also be formed by additive manufacturing using a metal material.

In the following, the configuration and effects of the heat exchange core 40 are described while focusing on matters different from the heat exchange core 10 according to the above-described embodiment. In the heat exchange core 40, components similar to the components of the heat exchange core 10 are denoted by the same reference numerals.

Figure 9B:
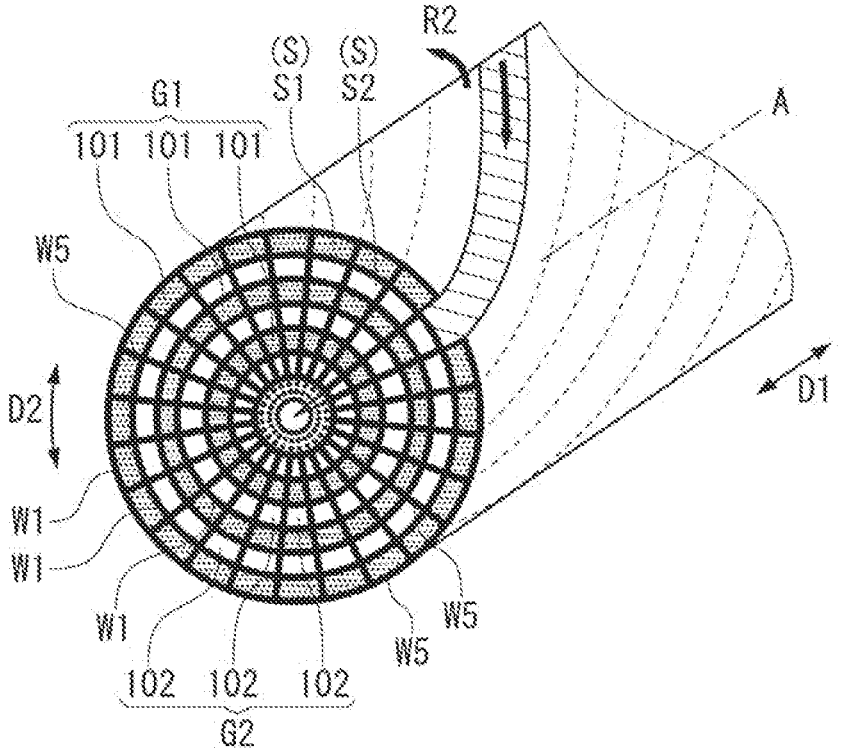
FIG. 9B is a diagram illustrating an inside of an alternate long and short dash line in the cross-section illustrated in FIG. 9A, and shapes of sections of first flow paths.

As illustrated in FIG. 9A and FIG. 9B, each of the first flow paths 101 and the second flow paths 102 is divided into a plurality of sections S by dividing walls W5.

To equalize the heat transfer coefficients in the circumferential direction D2, the sections S each preferably have an equal flow path diameter and are preferably arranged over the entire circumference of the heat exchange core 40.

As illustrated in FIG. 9A, the sections S (S2) forming the second flow paths 102 are formed in a spiral shape around an axis A of the heat exchange core 40. Further, as illustrated in FIG. 9B, the sections S (S1) forming the first flow paths 101 are also formed in a spiral shape around the axis A.

The spiral drawn by each of the sections S1 and the spiral drawn by each of the sections S2 are opposite in direction. When the sections S1 of the first flow paths 101 and the sections S2 of the second flow paths 102 are viewed from one end side D11 (FIG. 8) in the axial direction D1, the sections S2 each extend in the spiral shape in a clockwise direction R1 as illustrated in FIG. 9A, and the sections S1 each extend in the spiral shape in a counterclockwise direction R2 as illustrated in FIG. 9B.

In FIG. 9A, an area of one section S2 is illustrated with an oblique line pattern. Likewise, in FIG. 9B, an area of one section S1 is illustrated with an oblique line pattern.

The dividing walls W2 (FIG. 3B) according to the above-described embodiment are each formed in parallel with the axial direction D1 of the heat exchange core 10, whereas the dividing walls W5 partitioning the sections S2 in the circumferential direction D2 are formed in a spiral shape in the clockwise direction R1 as viewed from the one end side D11 (FIG. 8) in the axial direction D1 as illustrated in FIG. 9A. Further, as illustrated in FIG. 9B, the dividing walls W5 partitioning the sections S1 in the circumferential direction D2 are formed in a spiral shape in the counterclockwise direction R2 as viewed from the one end side D11 in the axial direction D1.

After the second fluid flows into the sections S2 of the second flow paths 102 from the one end side D11 in the axial direction D1 as illustrated by dashed arrows in FIG. 8, the second fluid flows from the one end side D11 toward the other end side D12 in the spiral shape in the clockwise direction R1 around the axis of the heat exchange core 40 along the sections S2.

In contrast, after the first fluid flows into the sections S1 of the first flow paths 101 from the other end side D12 in the axis direction D1 as illustrated by solid arrows in FIG. 8, the first fluid flows in the spiral shape in a direction (counterclockwise direction R2) opposite to the flow direction of the second fluid, along the sections S1, and crosses the flow of the second fluid. The first fluid at this time flows in the spiral shape in the clockwise direction as viewed from the other end side D12.

In the case where the sections S1 and S2 are each formed in parallel with the axial direction D1 as in the above-described embodiment, positional relationship between a specific section S1 (optional one section S1, the same applies hereinafter) and a specific section S2 (optional one section S2, the same applies hereinafter) in the cross-section C1 of the heat exchange core 40 is not changed in the other cross-section C4 (FIG. 8) separated from the cross-section C1 in the axial direction D1.

In contrast, when the sections S1 and S2 are each formed in the spiral shape in the opposite directions as viewed from the one end side D11 of the heat exchange core 40, the positional relationship between the specific section S1 and the specific section S2 is changed in the axial direction D1. In other words, when the specific section S1 is adjacent to the specific section S2 (for example, section S2 painted in black in FIG. 9A) in the cross-section C1 with the position of the specific section S2 as a reference, another section S1 is adjacent to the specific section S2 in the cross-section C4. The section S1 adjacent to the black section S2 in the cross-section C1 is separated from the black section S2 in the counterclockwise direction R2 as viewed from the one end side D11, in the cross-section C4.

Due to nonuniformity of the flow rates of the first fluid and the second fluid respectively flowing into the first flow paths 101 and the second flow paths 102 and the like, a place where a temperature is locally high or a place where the temperature is locally low may be present in the first flow paths 101 and the second flow paths 102 of the heat exchange core 40.

For example, even when the place where the temperature is locally high (section S2 painted in black in FIG. 9A) is present in any of the second flow paths 102 in the cross-section C1 of the heat exchange core 40, the section S2 where the temperature is locally high sequentially exchanges heat with each of the sections S1 arranged in the circumferential direction D2 because the second fluid flows along the sections S2 in the clockwise direction R1 and the first fluid flows along the sections S1 in the counterclockwise direction R2. Therefore, it is possible to suppress nonuniformity of the heat transfer amount in the heat exchange core 40.

In the present modification, the example in which the first fluid and the second fluid form the countercurrent flows is described. However, even in a case where the first fluid and the second fluid form parallel current flows, effects similar to the above-described operational effects can be achieved because the second fluid flowing in the clockwise direction R1 and the first fluid flowing in the counterclockwise direction R2 as viewed from the one end side D11 cross each other.

In the example illustrated in FIG. 9A and FIG. 9B, the sections S1 and S2 are set so as to divide the first flow path group G1 and the second flow path group G2 with equal center angles in the same cross-section of the heat exchange core 40. In this case, the dividing walls W5 of the first flow paths 101 and the dividing walls W5 of the second flow paths 102 are radially formed from the axial center of the heat exchange core 40 while being continuous in the radial direction of the heat exchange core 40.

Figure 10:
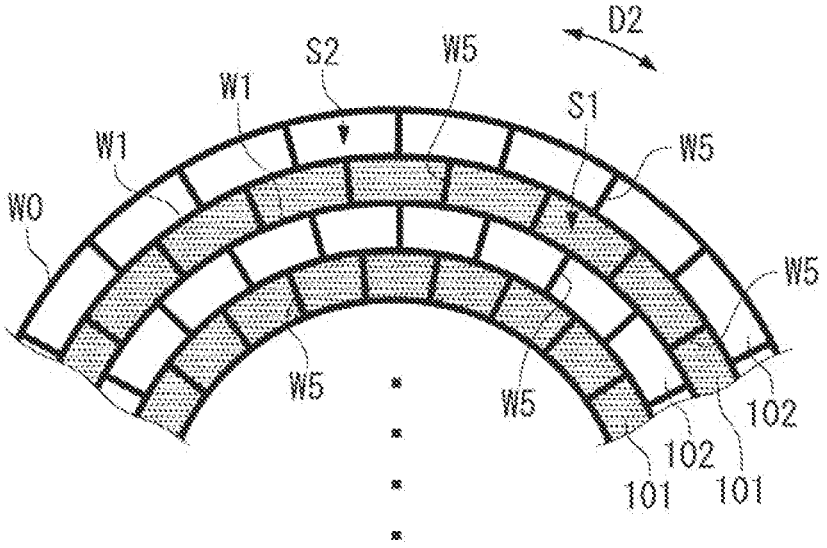
FIG. 10 is a diagram illustrating a modification relating to arrangement of partition walls. An embodiment is described below with reference to accompanying drawings.

In contrast, as illustrated in FIG. 10, the positions of the dividing walls W5 of each first flow path 101 and the positions of the dividing walls W5 of each second flow path 102 may be different, in the circumferential direction D2, between the adjacent first and second flow paths 101 and 102 in the radial direction. This is preferable because the stress acting on the heat exchange core 40 is uniformly distributed in the circumferential direction D2. Note that the arrangement of the dividing walls W5 illustrated in FIG. 10 is applicable to the dividing walls W2 (FIG. 3B) extending in parallel with the axial direction D1 of the heat exchange core 10, without being limited to the dividing walls W5 each formed in the spiral shape.

As illustrated in FIG. 3B described above, even in the case where the flow path diameters of the sections S are made equal to one another, the positions of the dividing walls W2 of each first flow path 101 in the circumferential direction D2 and the positions of the dividing walls W2 of each second flow path 102 in the circumferential direction D2 are different between the adjacent first and second flow paths 101 and 102 in the radial direction. This is preferable in terms of stress distribution.

Further, unlike the case where the dividing walls W5 are radially formed from the axial center of the heat exchange core 40, when the heat exchange core 10 is designed such that the flow path cross-sectional areas of the sections S are made equal in the layers of the heat exchange core 10 by arranging the dividing walls W2 (or W5) in such a way that positions of the dividing walls W2 (or W5) in the circumferential direction D2 are different between the adjacent first and second flow paths 101 and 102 in the radial direction of the heat exchange core 10 (or 40), it is possible to secure the predetermined heat transfer performance and pressure resistance while avoiding upsizing of the heat exchanger 1 as described above.

(Supplementary Note)

The heat exchange core, the heat exchanger, and the method of manufacturing the heat exchange core according to the above-described embodiment are understood as follows.

(1) A heat exchange core according to a first aspect is a heat exchange core 10 or 40 which performs heat exchange between a first fluid and a second fluid, and includes a circular first cross-section C1 in which a first flow path group G1 for the first fluid and a second flow path group G2 for the second fluid are positioned. First flow paths 101 included in the first flow path group G1 and second flow paths 102 included in the second flow path group G2 are annularly arranged in the first cross-section C1. The first flow path group G1 and the second flow path group G2 are concentrically arranged as a whole in the first cross-section C1. Each of the first flow paths 101 and the second flow paths 102 is divided into a plurality of sections S (or S1 and S2) in a circumferential direction D2 of the heat exchange core 10.

Based on the configuration in which the first flow path group G1 and the second flow path group G2 are symmetrically and concentrically stacked, heat exchange can be efficiently performed over the whole of the heat exchange core through which the first fluid and the second fluid equally flow, while stress caused by pressure of the fluids and the like is uniformly distributed to the whole of the heat exchange core and the heat transfer area of the first fluid and the second fluid is largely secured.

In addition, since each of the flow paths (101 and 102) is divided into the sections S, the heat transfer efficiency can be improved. Further, rigidity and strength of the heat exchange core particularly in the radial direction can be improved by walls (W2 and W5) dividing the flow paths into the sections S.

As described above, the "circular shape" includes the substantially circular shape, the "annular shape" includes the substantially annular shape, and the "concentric shape" includes the substantially concentric shape.

(2) A heat exchange core according to a second aspect further includes a second cross-section C2 in which traverse paths 14 traversing the first flow path group G1 and the second flow path group G2 are positioned. The traverse paths 14 communicate with one of the first flow path group G1 and the second flow path group G2, are separated from another of the first flow path group G1 and the second flow path group G2, and extend along a radial direction of the heat exchange core 10 in the second cross-section C2.

One of the first fluid and the second fluid flows from the traverse paths 14 into each of the flow paths (101 or 102) by being repeatedly branched, or flows out from each of the flow paths (101 or 102) to the traverse paths 14 by being repeatedly merged. In other words, it is possible to communicate each of the flow paths of the flow path group (G1 or G2) to outside of the heat exchange core by simple paths through the traverse paths 14 traversing the flow path group.

(3) In a heat exchange core according to a third aspect, two or more traverse paths 14 are distributed in the circumferential direction D2 of the heat exchange core 10.

As a result, rigidity and strength of the heat exchange core can be made uniform in the circumferential direction D2. In addition, the fluid equally flows into each of the traverse paths 14 distributed in the circumferential direction D2, and the fluid further equally flows into each of the flow paths (101 or 102) from the traverse paths 14. Alternatively, the fluid equally flows out from each of the flow paths (101 or 102) to the traverse paths 14 and the fluid further equally flows out from the traverse paths 14 to outside of the heat exchange core. Therefore, it is possible to equalize the flow state of the fluid in the circumferential direction D2.

(4) In a heat exchange core according to a fourth aspect, each of the two or more traverse paths 14 has an equal flow path cross-sectional area.

This makes it possible to uniformly secure a length of a section where the first fluid and the second fluid flow in the axial direction D1, in the circumferential direction D2 of the first flow paths 101 and the second flow paths 102.

(5) A heat exchange core according to a fifth aspect further includes a third cross-section C3 positioned on outside of the second cross-section C2 in an axial direction D1 orthogonal to a cross-section of the heat exchange core 10. Out of the first flow path group G1 and the second flow path group G1, one flow path group communicating with outside of the heat exchange core 10 by the traverse paths 14 is closed in the third cross-section C3.

With this configuration, out of the first flow path group G1 and the second flow path group G2, one flow path group communicating with the traverse paths 14 is separated from the other flow path group in the axial direction D1. Therefore, it is possible to avoid interference and complication of the inflow paths and the outflow paths of each of the first fluid and the second fluid. As a result, it is possible to configure the whole of the heat exchanger including the heat exchange core, the casing, and headers to fit well.

(6) In a heat exchange core according to a sixth aspect, a flow direction of the first fluid flowing through the first flow path group G1 along an axial direction D1 orthogonal to a cross-section of the heat exchange core 10 is opposite to a flow direction of the second fluid flowing through the second flow path group G2 along the axial direction D1. In this case, the first fluid and the second fluid form countercurrent flows.

As a result, the first fluid and the second fluid easily secure temperature difference while flowing through the flow paths (101 and 102). Therefore, the heat exchange is efficiently performed.

(7) In a heat exchange core according to a seventh aspect, partition walls W1 partitioning the first flow path group G1 and the second flow path group G2 each include a protrusion 103 rising toward at least one of the first flow path 101 and the second flow path 102. The protrusion 103 can increase the heat transfer area.

(8) In a heat exchange core according to an eighth aspect, the plurality of sections S each have an equal flow path diameter over whole of the first flow path group G1 and the second flow path group G2.

As a result, a flow state such as friction loss is made uniform among all of the sections S, so that the heat transfer coefficients among all of the sections S can be made uniform. In addition, as the stress is uniformly distributed to the whole in an in-plane direction of the cross-section of the heat exchange core 10, the stress can be made uniform.

(9) In a heat exchange core according to a ninth aspect, positions of dividing walls W2 (or W5) dividing the sections S (or S1 and S2) in the circumferential direction D2 of the heat exchange core are different, in the circumferential direction D2, between the adjacent first and second flow paths 101 and 102 in a radial direction of the heat exchange core. With this configuration, stress can be uniformly distributed in the circumferential direction D2 of the heat exchange core.

In addition, unlike the case where the dividing walls W2 (or W5) are radially formed from the axial center of the heat exchange core 40, when the heat exchange core 10 is designed such that the flow path cross-sectional areas of the sections are made equal in the layers of the heat exchange core 10, it is possible to secure predetermined heat transfer performance and pressure resistance while avoiding upsizing of the heat exchanger 1.

(10) In a heat exchange core according to a tenth aspect, the sections S1 and S2 of the first flow paths 101 and the second flow paths 102 are formed in a spiral shape around an axis of the heat exchange core. With this configuration, even when a place where a temperature is locally high or a place where the temperature is locally low is present in the first flow paths 101 and the second flow paths 102 due to nonuniformity of the flow rates or the like, the nonuniformity of the heat transfer amount in the circumferential direction D2 can be suppressed by heat exchange between the first fluid and the second fluid flowing through the sections S1 and S2.

(11) In a heat exchange core according to an eleventh aspect, the sections (S1 or S2) of one of the first flow paths 101 and the second flow paths 102 extend in a clockwise direction R1 as viewed from one end side D11 in the axial direction D1 of the heat exchange core 40, and the sections (S1 or S2) of another of the first flow paths 101 and the second flow paths 102 extend in a counterclockwise direction R2 as viewed from the one end side D11 in the axial direction D1. With this configuration, the first fluid and the second fluid exchange heat while flowing in the spiral shapes over the entire circumference of the heat exchange core 10. Therefore, it is possible to suppress nonuniformity of the heat transfer amount over the entire circumference of the heat exchange core 10.

(12) A heat exchanger according to the first aspect includes the above-described heat exchange core 10 or 40, and a casing 20 having a circular cross-section and housing the heat exchange core 10 or 40.

The heat exchange core 10 or 40 and the casing 20 are both formed symmetrically about a center of the cross-section. As a result, in the heat exchange core 10 or 40 and the casing 20, stress caused by pressure of the fluids and the like is uniformly distributed, and heat exchange performance is made uniform.

This makes is possible to improve reliability and performance of the heat exchanger.

(13) A heat exchanger according to the second aspect includes a heat exchange core 10 or 40 including traverse paths 14, and a casing 20 having a circular cross-section and housing the heat exchange core. A communication space (internal spaces 221A and 222A of headers) communicating the traverse paths 14 with outside of the heat exchange core 10 is provided around the heat exchange core 10 inside the casing 20.

By using a part of the casing as the internal spaces 221A and 222A of the headers, the configuration of the heat exchanger including the headers can be simplified.

(14) A method of manufacturing the heat exchange core according to any of the first to eleventh aspects is a method of manufacturing the heat exchange core 10 which performs heat exchange between the first fluid and the second fluid. The heat exchange core includes a circular first cross-section in which a first flow path group for the first fluid and a second flow path group for the second fluid are positioned. First flow paths included in the first flow path group and second flow paths included in the second flow path group are annularly arranged in the first cross-section. The first flow path group and the second flow path group are concentrically arranged as a whole in the first cross-section. The method includes forming the first flow path group G1 and the second flow path group G2 by additive manufacturing using a metal material.

Since the heat exchange core can be integrally formed by additive manufacturing, it is not necessary to assemble members and to seal a gap between the members by a gasket. Therefore, a time and effort for maintenance can be largely reduced.

Other than the above description, the configurations described in the above-described embodiment can be selected or appropriately changed to other configurations.

REFERENCE SIGNS LIST

1 heat exchanger
10, 40 heat exchange core
10A one end
10B another end
14 traverse path
20 casing
21 casing main body
22 large-diameter portion
22A inlet port
22B outlet port
31 second inlet header
31A flange
32 second outlet header
32A flange
101 first flow path
102 second flow path
103 protrusion
221 first inlet header
221A internal space (communication space)
222 first outlet header
222A internal space (communication space)
231, 232 flange
A axis
C1 first cross-section
C2, C2*x* second cross-section
C3, C3*x* third cross-section
C4 cross-section
D1 axial direction
D11 one end side
D12 another end side
D2 circumferential direction
G1 first flow path group
G2 second flow path group
L perimeter
R1 clockwise direction
R2 counterclockwise direction
S section
W0 side wall
W1 partition wall
W2, W5 dividing wall
W3 traverse wall
W4 closure wall

The invention claimed is:

1. A heat exchange core which performs heat exchange between a first fluid and a second fluid, the heat exchange core comprising a circular first cross-section in which a first flow path group for the first fluid and a second flow path group for the second fluid are positioned, wherein first flow paths included in the first flow path group and second flow paths included in the second flow path group are annularly arranged in the first cross-section, the first flow path group and the second flow path group are concentrically arranged as a whole in the first cross-section, each of the first flow paths and the second flow paths is divided into a plurality of sections in a circumferential direction of the heat exchange core, each section of each of the first flow paths, and each section of each of the second flow paths, extends along an axis of the heat exchange core while spiraling around the axis of the heat exchange core, the sections of one of the first flow paths and the second flow paths spiral around the axis of the heat exchange core in a clockwise direction as viewed from one end side in an axial direction of the heat exchange core, the sections of another of the first flow paths and the second flow paths spiral around the axis of the heat exchange core in a counterclockwise direction as viewed from the one end side in the axial direction, and wherein for one of the first flow paths and one of the second flow paths which are adjacent to each other in a radial direction of the heat exchange core, positions of dividing walls dividing the sections in the circumferential direction of the heat exchange core in the one of the first flow paths are different, in the circumferential direction, from positions of dividing walls dividing the sections in the circumferential direction of the heat exchange core in the one of the second flow paths.

2. The heat exchange core according to claim 1, further comprising a second cross-section in which a traverse path traversing the first flow path group and the second flow path group is positioned, wherein the traverse path communicates with one of the first flow path group and the second flow path group, is separated from another of the first flow path group and the second flow path group, and extends along a radial direction of the heat exchange core in the second cross-section.

3. The heat exchange core according to claim 2, wherein the traverse path comprises two or more traverse paths distributed in the circumferential direction of the heat exchange core.

4. The heat exchange core according to claim 3, wherein each of the two or more traverse paths has an equal flow path cross-sectional area.

5. The heat exchange core according to claim 2, further comprising a third cross-section positioned on an outside of the second cross-section in the axial direction, wherein out of the first flow path group and the second flow path group, one flow path group communicating with an outside of the heat exchange core by the traverse path is closed in the third cross-section.

6. A heat exchanger, comprising:

the heat exchange core according to claim 2; and a casing having a circular cross-section and housing the heat exchange core, wherein a communication space communicating the traverse path with an outside of the heat exchange core is provided around the heat exchange core inside the casing.

7. The heat exchange core according to claim 1, wherein a flow direction of the first fluid flowing through the first flow path group around the axis of the heat exchange core is opposite to a flow direction of the second fluid flowing through the second flow path group around the axis of the heat exchange core.

8. The heat exchange core according to claim 1, wherein a partition wall partitioning the first flow path group and the second flow path group includes a protrusion rising toward at least one of the first flow path and the second flow path.

9. The heat exchange core according to claim 1, wherein the plurality of sections each have an equal flow path diameter over the whole of the first flow path group and the second flow path group.

10. A heat exchanger, comprising:

the heat exchange core according to claim 1; and a casing having a circular cross-section and housing the heat exchange core.

11. A method of manufacturing the heat exchange core according to claim 1, comprising forming the first flow path group and the second flow path group by additive manufacturing using a metal material.

* * * * *